US009732955B2

(12) United States Patent
Hui et al.

(10) Patent No.: US 9,732,955 B2
(45) **Date of Patent: *Aug. 15, 2017**

(54) POOL LIGHT ASSEMBLY WITH COOLING STRUCTURE

(71) Applicants: Wing-kin Hui, Hong Kong (CN); Wing-tak Hui, Hong Kong (CN)

(72) Inventors: Wing-kin Hui, Hong Kong (CN); Wing-tak Hui, Hong Kong (CN)

(73) Assignee: COMPUROBOT TECHNOLOGY COMPANY, Dongguan (CN)

( * ) Notice: Subject to any disclaimer, the term of this patent is extended or adjusted under 35 U.S.C. 154(b) by 47 days.

This patent is subject to a terminal disclaimer.

(21) Appl. No.: 13/965,141

(22) Filed: Aug. 12, 2013

(65) Prior Publication Data

US 2015/0043195 A1 Feb. 12, 2015

(51) Int. Cl.

| | |
|---|---|
| ***F21V 33/00*** | (2006.01) |
| ***F21V 31/00*** | (2006.01) |
| ***E04H 4/12*** | (2006.01) |
| ***B05B 1/00*** | (2006.01) |
| ***B05B 1/26*** | (2006.01) |
| *E04H 4/14* | (2006.01) |
| *F21W 131/401* | (2006.01) |
| *F21Y 103/33* | (2016.01) |
| *F21Y 115/10* | (2016.01) |

(52) U.S. Cl.

CPC ..... *F21V 31/005* (2013.01); *B05B 1/00* (2013.01); *B05B 1/267* (2013.01); *E04H 4/12* (2013.01); *E04H 4/148* (2013.01); *F21W 2131/401* (2013.01); *F21Y 2103/33* (2016.08); *F21Y 2115/10* (2016.08)

(58) Field of Classification Search

CPC .. B05B 1/00; B05B 1/267; E04H 4/12; F21V 31/005

USPC ..... 362/96, 101; 239/589

See application file for complete search history.

(56) References Cited

U.S. PATENT DOCUMENTS 7,427,036 B2 * 9/2008 Skluzacek et al. ..... 239/18

* cited by examiner

*Primary Examiner* — Andrew Coughlin
*Assistant Examiner* — Meghan Ulanday
(74) *Attorney, Agent, or Firm* — Weiss & Moy, P.C.; Jeffrey D. Moy

(57) ABSTRACT

Disclosed herein is a pool light assembly including cooling for the illuminating structure. The assembly includes a water inlet housing having a portion on the dry side and a portion immersed in the pool water. An assembly having sealing structure creates a leak proof connection with the pool wall. The submerged portion of the assembly includes a base. The base has an exterior exposed to the pool water and an enclosed interior including the illuminating structure. A notch is provided in the exterior of the base and extends into the interior for allowing pool water in the proximity of the illuminating structure. The assembly includes sealing structure for preventing water from entering electrically active elements, while allowing pool water to act as a cooling element. A retaining member locks and encourages waterproof sealing of the electrically active elements. Each of the elements is provided with structure as necessary to facilitate the free flow of water through the housing.

4 Claims, 6 Drawing Sheets

POOL LIGHT ASSEMBLY WITH COOLING STRUCTURE

RELATED APPLICATIONS

This is a continuation application of application Ser. No. 13/013,459, filed Jan. 25, 2011 by the same inventive entity, namely Wing-kin HUI and Wing-tak HUI.

This application is related to application Ser. No. 12/854,170, filed by co-inventor, Wing-kin HUI, for A POOL LIGHT ASSEMBLY, filed on Aug. 11, 2010. This application is specifically incorporated herein and is to be used for all purposes consistent with incorporation by reference.

FIELD OF THE INVENTION

This invention relates generally to the field of pool equipment, either above or in-ground pools. More particularly, this invention relates to pool fixtures designed for adapting a pool light assembly to a pool. Most particularly, this invention relates to the field of such devices, which offer pool illumination plus cooling of the illumination device and surrounding structure.

BACKGROUND OF THE INVENTION

Recently, pool lighting has become more popular. While, pool lighting has been around for many years, the issues associated with such lighting have not been fully appreciated. For example, some illumination devices, especially in the beginning, used lighting elements that would get extremely hot and cause rapid deterioration of the entire lighting assembly. Such heat would lead to increased maintenance by the pool owner and constant replacing of not only the light assembly unit, but also the entire inlet housing. Sometimes a pool would need to be drained just to do the necessary maintenance.

Despite these and other issues, pool lighting has become increasingly popular. Initially pool lighting was used strictly for safety purposes. Nighttime swimming, although not terribly popular, was done with much greater safety at night with lighted pools for obvious reasons.

After adding lighting, perhaps initially for safety reasons, pool owners and visitors, and others noticed the calming effort of nighttime lighting on the pool water. Visitors and pool owners alike noticed the tranquil effect sitting by the pool at night had with such lighting.

The increased popularity led to additional enhancements. For example, color lighting has frequently been added to create nighttime pool water as a home's water feature. Such lighting provided viewers with greater interest and had the same or greater benefits to peaceful and tranquil viewing. Additional enhancements such as sequential color lighting have also been added.

While, the above and other enhancements have clearly made lighting swimming pools, more desirable and even more readily available, none of the above has focused on the issue of heat dissipation. For example, halogen lighting has commonly been used until quite recently. However, the energy demands for such lighting have prompted government officials to discourage and even ban their usage. Today, high and ultra high intensity LED's are the main source of pool illumination lighting elements. These heating elements give off a tremendous amount of heat individually and exponentially additional heat when combined in series such as that favored in colored pool illumination systems.

Additionally, many of today's pool illumination systems use a reflector or reflector plate. This increases the focus and intensity of the lighting for greater and more desirable effects. However, as can be appreciated, such a reflector does not relieve, but rather increases the amount of heat in the illumination system.

What is needed is a structure for allowing a pool lighting installation to be cooled without resorting to undue structure or expensive maintenance. The ideal structure would conform in general physical appearance and dimensions of existing pool water inlets or returns, while providing cooling to the needed structure of the illumination structure.

SUMMARY OF THE INVENTION

The structure of the improved pool light assembly with cooling structure in accordance with the present invention includes using the existing pool inlet or return with a few structural modifications. These structural modifications include providing a housing inlet having a first portion on the dry side of the pool wall and a second portion immersed in the pool water. The second portion includes a flange exterior and the interior defining a base. One or more openings on the flange allow pool water into the base. The housing is secured to the pool water by means well known in the art. The base is provided with a series of ridges, which encourage pool water circulation through the base. Sealing and retaining members separate the water from the electrical elements and retaining the unit together in working order. This way pool water is used to circulate around the light assembly in close proximity to the lighting elements. Using this structure, the cooling of the light assembly occurs without undue modifications to the existing pool and lighting structures.

It is an object of this invention is to provide a pool light assembly, which uses pool water to cool the assembly.

It is another object of this invention to provide a pool light assembly, which includes the basic existing light assembly and allows modifications to both improve reliability of the assembly and allow the latest illumination elements to be used.

In accordance with the objects set forth above and as will be described more fully below, the pool light assembly in accordance with this invention, comprises:

A pool light assembly for use with swimming pools for connection to a pool side wall, the pool including a water inlet housing having a water conduit, the pool light assembly comprising:

the water inlet housing having a base and the base having an interior, the base having a notch for allowing water to enter the interior, the interior of the base having a series of ribs and a central opening for allowing water to communicate with the water conduit;

a sealing plate for sealing water between the base interior and the sealing plate, the sealing plate including a central opening sized and shaped for compatible connection with the central opening of the base and allowing water to communicate with the water conduit;

a light sub-assembly including means for pool illumination, the light sub-assembly defining a ring fitting sized and shaped to fit within the periphery of the sealing plate; and a retaining means for retaining the light sub-assembly in place with the aforementioned components.

In one exemplary embodiment, the light assembly interior base includes a series of radially extending ribs, which are separated by opposed dividers. This pattern has been found to facilitate the flow of pool water in the proximity to the light sub-assembly and in so doing adds to the cooling effect of the structure.

In another exemplary embodiment, the light assembly includes the light assembly includes a reflector plate as part of the retaining ring. The reflector plate reflects light and facilitates a brighter and more intense lighting display. The reflector plate focuses and concentrates the light as desired and this can especially enhance a lighting pattern with multi-colored lights.

In still another exemplary embodiment, the assembly includes a plurality of lighting elements; each of the lighting elements being positioned around the ring in a rotary extending pattern. The light elements are, in one embodiment unevenly spaced apart. In another embodiment the lights are of various colors. In these and other embodiments, the lighting elements are high intensity LED's.

Of course, various other exemplary embodiments are possible to achieve various objects of the invention within the spirit and scope of this invention.

It is an advantage of the pool light assembly of this invention to provide a structure that uses pool water to cool the heat generated by high intensity lighting elements.

It is an additional advantage of the pool light assembly in accordance with the instant invention to provide to both above and in-ground pools with such a lighting assembly having cooling structure.

It is an additional advantage of the pool light assembly in accordance with the instant invention to provide to new and existing pool structures with such a lighting assembly having cooling structure.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

In order to appreciate the invention herein, one must appreciate the need in the art as set forth in the Background. Most importantly, the structure herein for resolving the long felt need to dissipate heat in a pool device having illumination capabilities.

Figure 1:
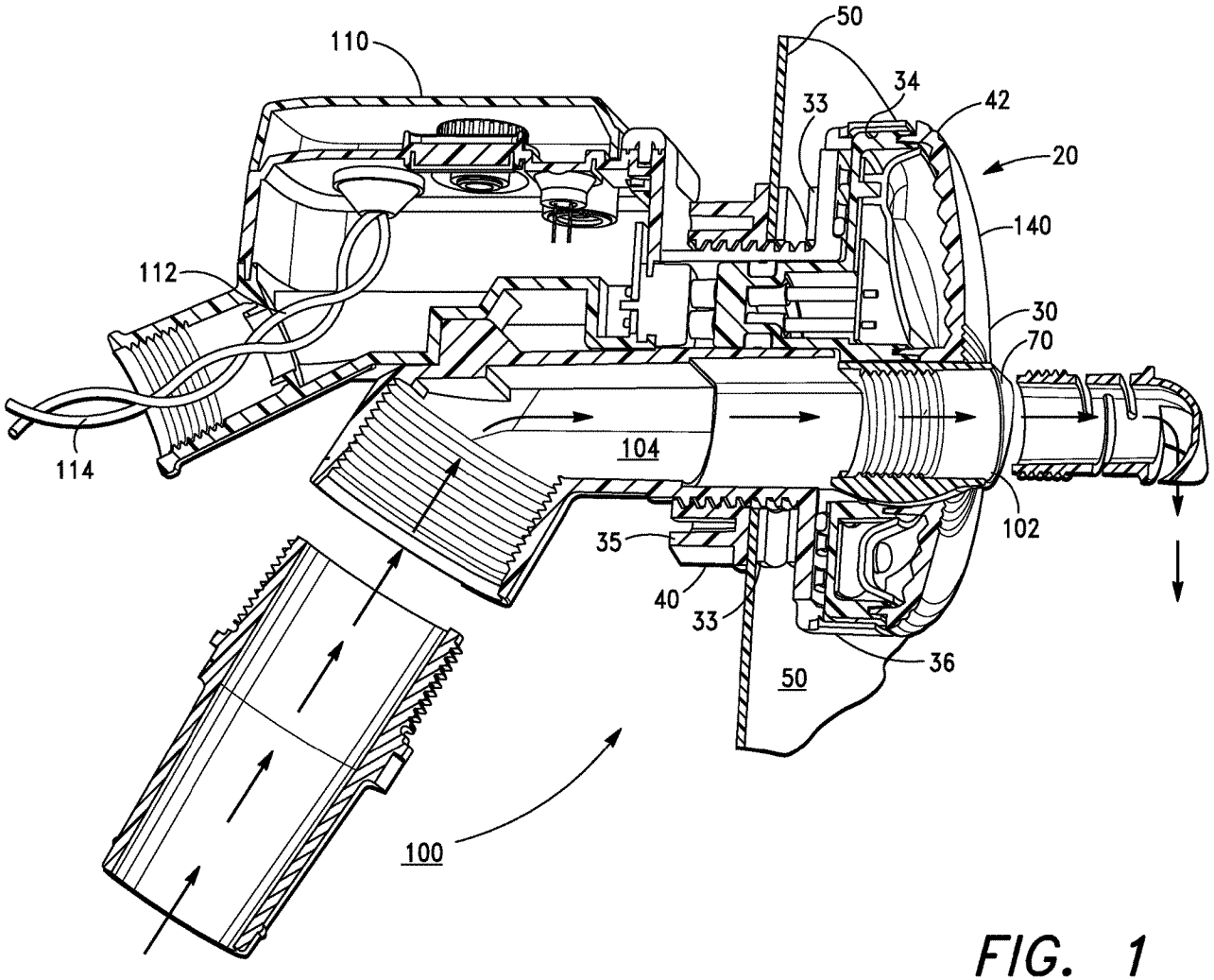
FIG. 1 is a cross sectional view of the pool water return inlet which includes a power supply head and the pool light assembly in accordance with this invention.

With particular reference to FIG. 1, there is shown an exemplary embodiment of a pool return 100. The pool return 100 includes a power supply head 110 and the pool light assembly in accordance with this invention, and generally denoted by the numeral 20. The pool return 100 includes a water inlet 102, which leads to a water channel 104.

Figure 2:
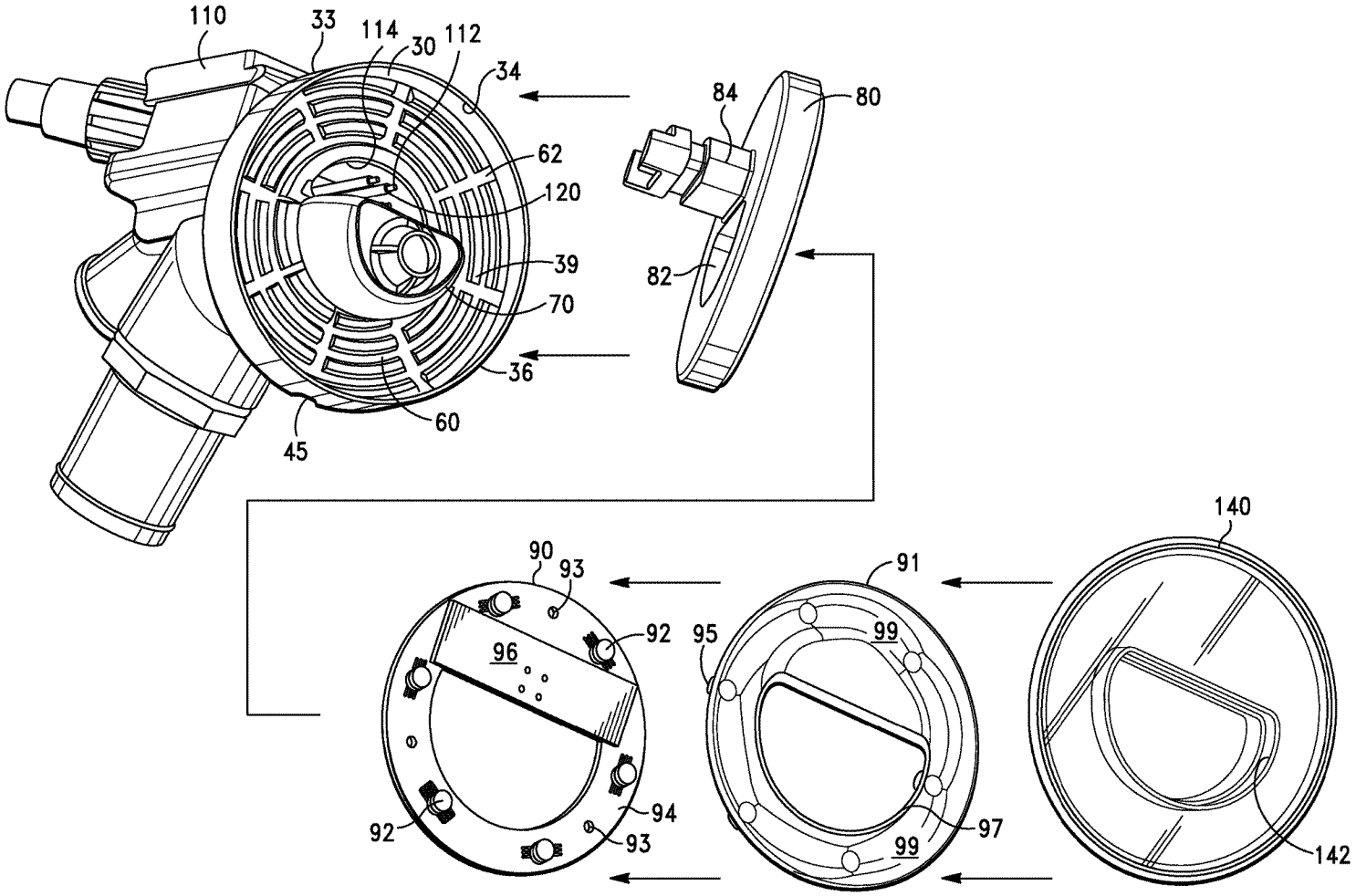
FIG. 2 illustrates an exploded view of the pool return having a light assembly in accordance with this invention.

As shown in FIGS. 1 and 2, the pool light assembly 20 includes a water inlet housing 30. The housing 30 has a central opening 31 defining the water channel 104. The power supply head 110 mates with the housing 30, as shown particularly clearly in FIG. 1. The power supply head 110 has an electrical channel 112 and is shown in FIG. 1 with electrical wires 112 extending to an electrical source (not shown) such as an electrical outlet (also, not shown). The power supply head 110 distributes power to the light assembly 20 through electrical conduit shown clearly in FIG. 1.

The housing 30 has an exterior 32. As shown in FIG. 1, the housing 30 is mounted on a pool wall 50. The housing 30 has a first portion 40 located on the dry side of the mounting and a second portion 42 immersed in pool water. In the embodiment shown in FIG. 1 two washers 33 on the pool side and a tightening nut 35 on the dry side form a water tight seal around the opening in the pool where the housing 30 is inserted.

Figure 3:
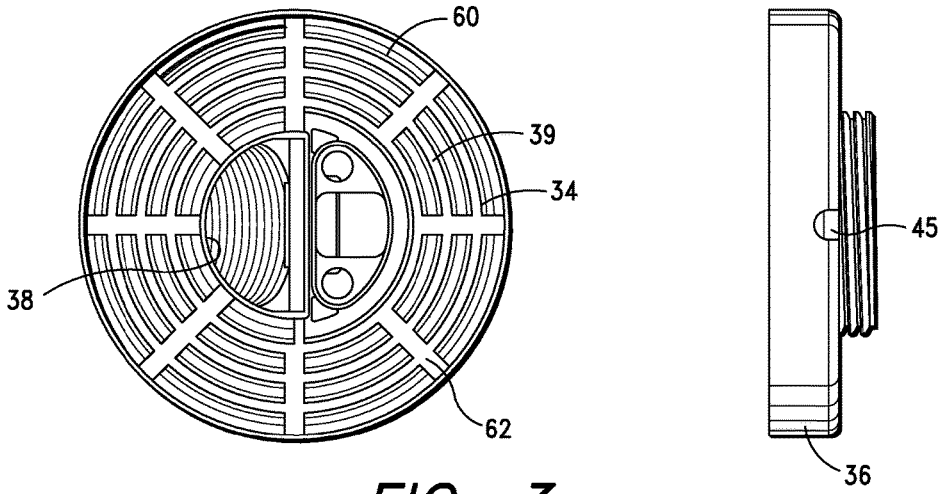
FIG. 3 illustrates an exemplary embodiment of the pool light assembly housing in accordance with this invention, shown in perspective from the front and rear.
Figure 4:
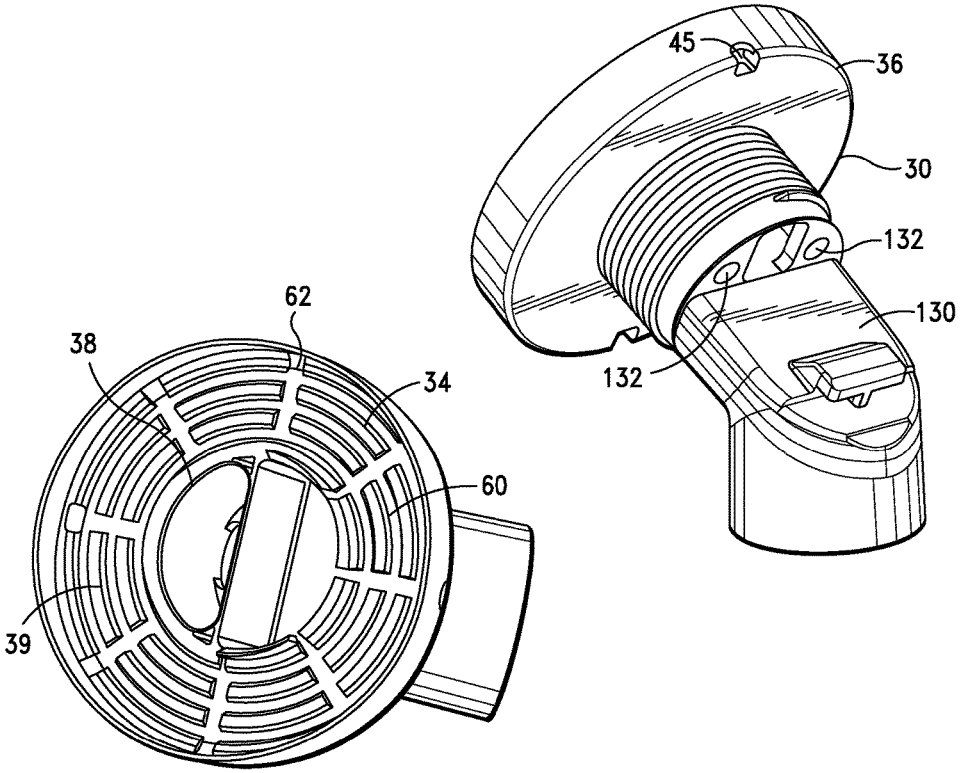
FIG. 4 illustrates another embodiment of an exemplary embodiment of the pool light assembly housing in accordance with this invention, shown in perspective from the front and rear.

The second portion 42 of the housing 30 includes a flange member 36. The flange member 36 has an interior 34 as best seen in FIGS. 2-4. The interior 34 has a central opening 38 allowing water to pass therethrough and communicate with the water channel 104 through inlet 102. The interior 34 defines a base 39 for the light assembly 20.

The flange member 36 sits, during operation, immersed in pool water. At least one notch 45 is provided in the exterior 32 of the flange member 36 extending into the interior 34. Thus, constructed, the notch 45 that allows pool water to communicate freely between the interior 34 and exterior 32 and throughout the flange member base 39.

The interior 34 includes a raised pattern of ribs 60 and dividers 62. The ribs 60 and dividers 62 can, of course, be made to have any particular pattern within the spirit and scope of the invention. For example, the pattern may well be non-symmetrical or zigzagged within the spirit and scope of the invention herein. The functional requirement for such a pattern is to ensure that water flows freely through the base 39 to provide a cooling effect for the light sub-assembly as described below.

With respect to FIG. 2, there is shown the terminus 120 for the electrical wires 112 within the electrical channel 110. Thus, the light assembly in accordance with this invention includes both an electrical channel and a water channel. This is particularly well described with respect to Applicant's earlier related invention and incorporated herein and referred to here as if set forth in full and incorporated herein for all purposes consistent with full disclosure and establishment of an antecedent basis.

A nozzle 70 fits over the water channel 104. As is well known in the art, such a nozzle defines an eyeball nozzle and can be useful in directing a limited amount of water flow in the pool. More recent developments in pool technology include Applicants' invention of vented directional nozzle as shown particularly with reference to FIGS. 10 and 11. The eyeball nozzle can either be replaced by such a directional nozzle or used in conjunction therewith as will be described below with reference to FIGS. 10 and 11.

In the embodiment shown in FIGS. 1 & 2, the base has two notches 45. It will be appreciated that only one such notch is required. However, two notches have been found to facilitate the flow of water through the base 39, which, of course, aids in the cooling of the light assembly. While, more notches are within the spirit and scope of the invention, such have not been found to greatly aid the cooling effect of pool water through the base and therefore, the best mode of carrying out the invention has to date been found by using the two notch embodiment illustrated by the drawing herein.

A sealing plate 80 covers and seals the base 39 when the light assembly is fully assembly as will be more fully appreciated below. The sealing plate 80 has a central opening 82 for allowing pool water to enter the water channel 104 and for maintaining open communication with pool water and the pool return 100.

The central opening 82 is also sized and shaped for compatible overlay with the nozzle 70 as also clearly shown in FIG. 2. The central opening 82 is large enough to allow some slight rotation movement of the nozzle 70 while providing a snug fit to discourage water leak paths through the base and into the other elements of the light assembly 20.

Additionally, the sealing plate 80 includes in the embodiment shown an electrical plug-in connection member 84. The member 84 is sized and shaped for compatible and mating connection with the electrical channel 112 and the plug-in connector therein. The member 84 fills the electrical channel 112 and the wiring 114 connects with the member allowing electrical connection there between.

A light sub-assembly 90 fits within the outer periphery of the sealing member 80. The light sub-assembly 90 includes a plurality of lighting elements 92 on a circuit board 94 in the shape of ring. The circuit board 94 includes a plug-in connector 96. As shown, the plug-in connector is sized and shaped for a mating force fit with the electrical wiring as shown. The lighting elements 92 obtain electrical power for the power supply head 110 through the wiring 112 when the plug-in connector 96 is plugged in also as illustrated in FIG. 2.

As discussed above, halogen lighting elements have become frowned upon because while they generate adequate light, they do so at a high energy costs. Lighting elements such as high intensity LED's are preferred in most situations. However, both types of lighting elements as well as others are within the spirit and scope of this invention.

A retaining member 91 is designed to snap fit over the light sub-assembly 90. In the embodiment shown, the light sub-assembly 90 includes posts 93 and the retaining member has female projections 95, which create a secure snap, fit there between. Additionally, the retaining member 91 has a central opening 97 for allow water to pass therethrough to the water channel 104. Additionally, the lighting elements, regardless of type, typically project from the light sub-assembly 90. Therefore, the retaining member 91 has a series of matching opening for allowing the lighting elements 92 to pass therethrough. Once assembled the retaining member 91 snap fits to the light sub-assembly 90 providing a secure assembly for the entire light assembly 20.

A lens cover 140 is provided to cover retaining member 91. Similarly, the lens cover 140 has a central opening 142 allowing communication of the pool water into the water channel 104. The lens cover 140 has periphery with a groove and as is known in the art snap fits into the outer periphery of the retaining member 91. The fit is secure to discourage any water from entering into the light assembly 20 except, of course, through the central opening 142.

As can be appreciated by those skilled in the art, the retaining member 91 in a preferred embodiment includes a reflective surface 99 surrounding the projecting lighting elements 92. Thus, structured, the retaining member 91 thereby defines a reflector plate.

Such a reflector plate is particular useful and desirable when colored lighting elements are used. As is known in the art the lighting elements may be of different colors by adapter different lighting element covers over the LEDS. Additionally, the lens cover 140 may be of different colors, having different color segments and shapes to provide more enhanced pool lighting.

As shown, the water channel 104 extends through the body of light assembly 20. The central openings in each of the above elements are aligned so as to create a single water channel 104.

With particular reference to FIGS. 3 and 4, there is shown the housing 30 outside of the pool wall 50. The flange 36 has an external screw exterior with an open channel for communicating with the water channel 104. With the additional of the washers 33 on the pool side of the pool wall 50, the housing is secured for leak proof connection. This is especially important on thin walled above ground pools. It is critical to create a connection that will not compromise the pool wall while providing a connection that also seals and prevents water leakage to the dry side of the pool.

As seen with particular reference to FIG. 4, the housing 30 is adapted to provide the power supply head 110 a location for easy and convenient plug-in connection. The housing 30 includes a flat surface 130 have head opening 132 which match and mate with the male connectors of the power supply head 110. Additionally, the flat surface 130 is provided with a locking member 134, which securely connects the power supply head 110 to the housing 30.

Figure 5:
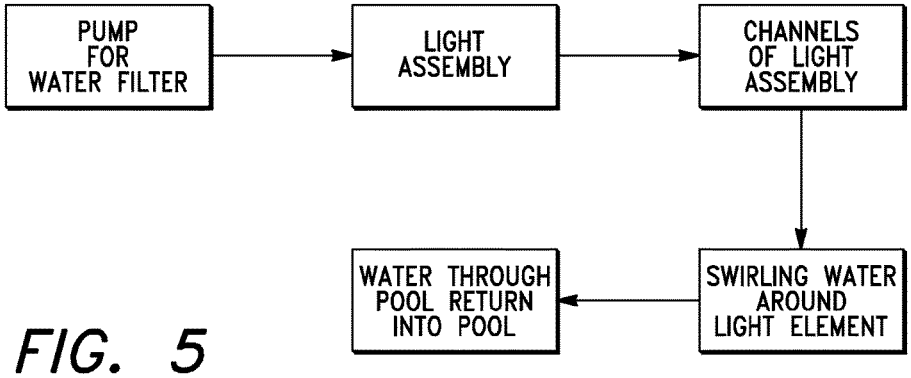
FIG. 5 illustrates, in schematic, the flow of water through the housing and the operation of the cooling structure of the light assembly.

With particular reference to FIG. 5, there is shown the schematic operation of the light assembly in accordance with this invention. As is conventional in the art, a water pump for filtering pool water is provided. The pump pumps water through the water channel of the light assembly and through the various central openings of the elements as described with respect to FIGS. 1 through 4. As the water, both fresh and pool flow through the light assembly and into the pool and are returned, water enters and exits through the notches 45 and swirls about the base 39 in close proximity to the light sub-assembly 90 and lighting elements 92 as described above. Fresh water flows through the water channel 104 and pool water through the return and into the pool.

Clearly, the source of the intense heat in the light assembly 20 is the lighting elements 92. The heat from these lighting elements 92 can be quite extreme. In an effort to cool the source of the heat, it is advantageous to locate the cooling source as close to the heating source as possible. However, this must been without compromising the electrical integrity of the light assembly 20 as a whole and without resorting to structures and devices which will not work within conventional structure already established in the art.

Figure 6:
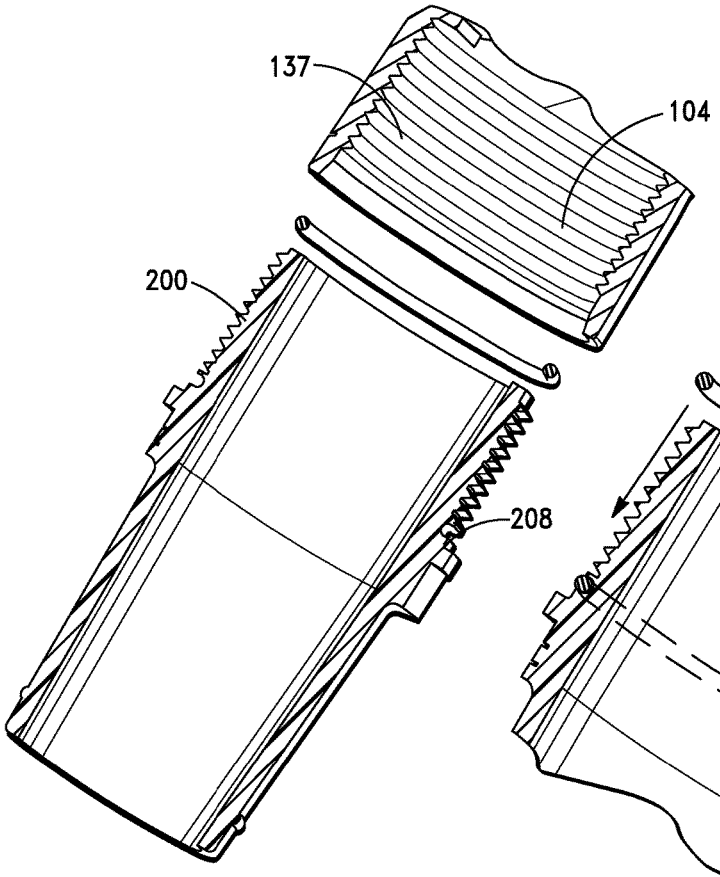
FIGS. 6 & 7 illustrate in cross-section, one embodiment of the water conduit of the light assembly housing in accordance with this invention.
Figure 7:
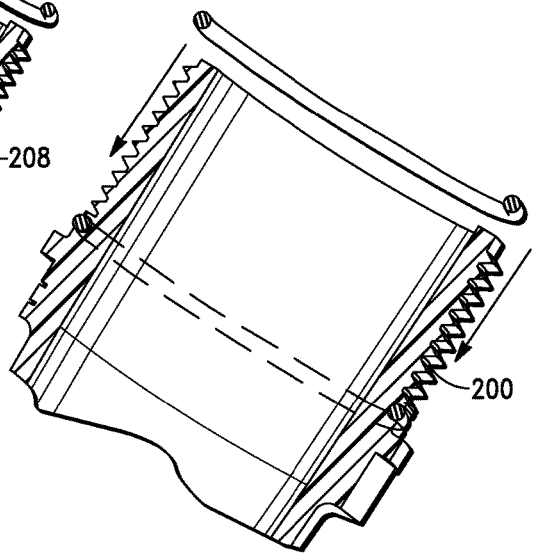

With particular reference to FIGS. 6 & 7, there is shown a novel concept for an advanced water channel return. The water channel 104 feeds into a filter and a fresh water source. In various known designs, there has been considerable leakage from the source and/or filter and the water channel. Applicants herein provide the housing 30 with dry side screw threads 137 for such connection. The novel concept includes an adapter 200 at the end of the water channel 204, which is provided with screw threads 202. The threads 202 mate compatibly with housing threads 137.

Between the end of the adapter 200 and the water channel 104, a compression ring 206 is provided. The adapter 200 includes a seat 208, sized and shaped for compatible compression fit with the adapter the ring 206.

As shown most clearly in FIG. 7, as the ends of the channel 104 and the adapter 200 are threaded. The compression ring slides compatibly into the seat 208. Further tightening of the adapter 200 to the channel 104 causes a secure water tight seal for the prevention of any leakage.

Figure 8:
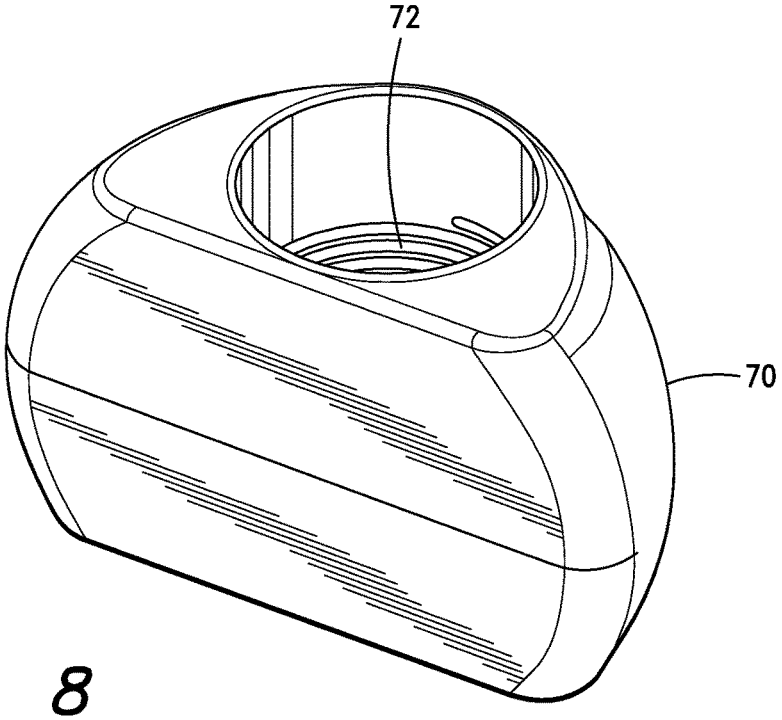
FIGS. 8 & 9 illustrate two embodiments of the nozzle used in connection with the pool light assembly in accordance with this invention.
Figure 9:
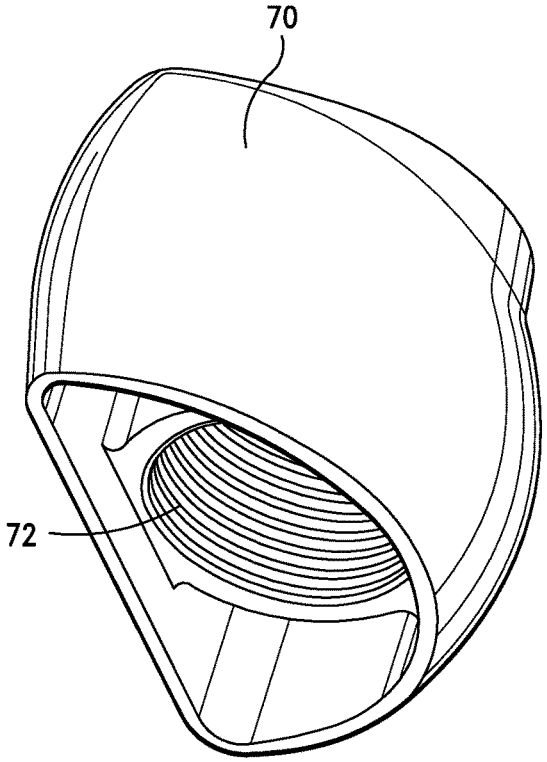

With particular reference to FIGS. 8 & 9, there is shown the eye-ball nozzle 70 in accordance with the instant invention. The nozzle 70 has a central opening consistent with allowing water to enter the water channel as described above. In an exemplarily embodiment of the nozzle 70, the central opening includes internal screw threads 72. As will be more fully appreciated from the description below with respect to FIGS. 10 and 11, the novel aspects of providing a directional nozzle are facilitated by such threads 72.

Additionally, the oblong and symmetrical shape of the nozzle 70 provides greater durability and reliability as well as providing the nozzle 70 with a degree of rotate. The shape results in more functionality over a simple round or spherical nozzle.

Figure 10:
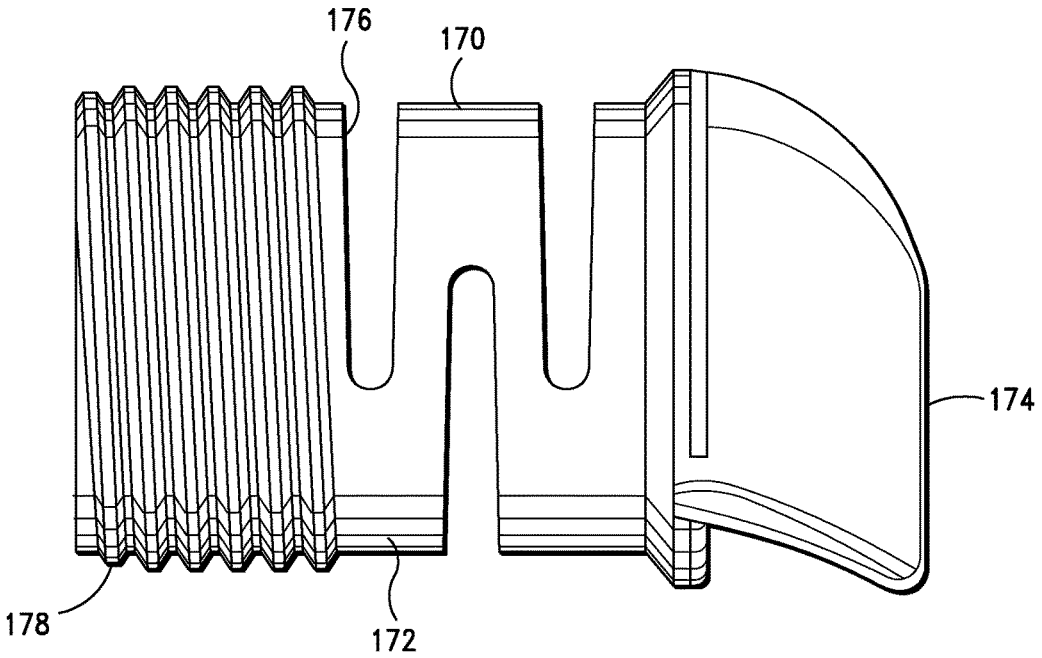
FIGS. 10 & 11 illustrate side and perspective views, respectively, of the directional nozzle used in connection with the pool light assembly in accordance with this invention.
Figure 11:
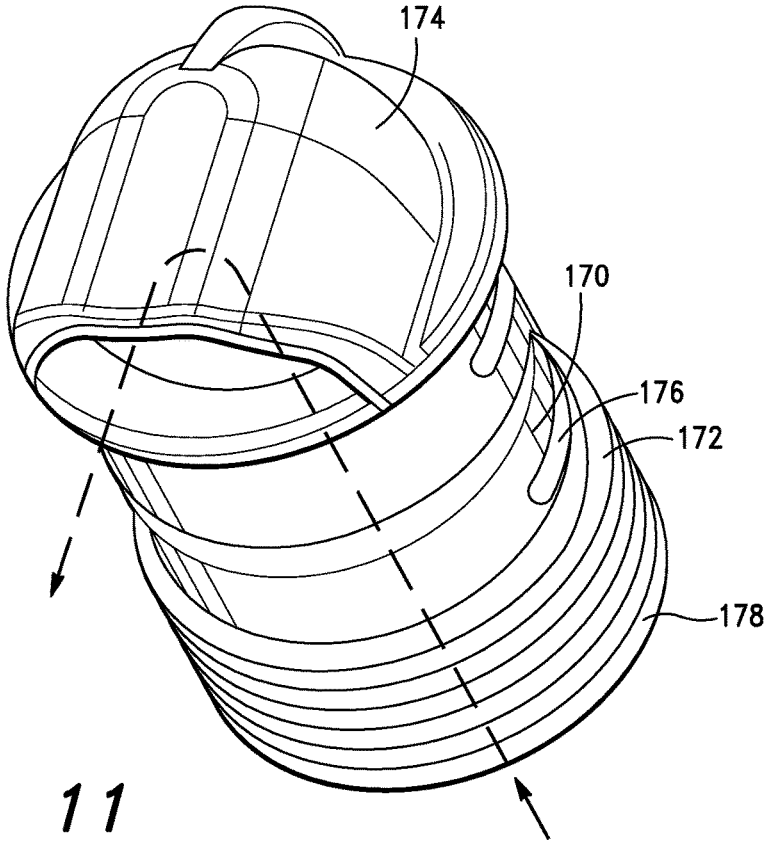

With particular reference to FIGS. 10 and 11, there is shown the vented directional nozzle 170. The nozzle 170 includes a main body 172 and a directional head end 174. The main body 172 has a series of vents 176. These vents 176 allow pool water to pass through without disturbing the flow to a great degree.

The head end 174 is partially closed and includes a hood, which deflects water at a right angle to the main body 172. The head end is rotated to the desired position to direct pool flow.

The main body 172 has an end 178 opposite the head end 174. The end 178 screws into the nozzle 70 of FIGS. 8 & 9 by using its threaded end. As a result of the vents 176 being present, over rotation of the directional nozzle 170 relative to the nozzle 70 does not result in breakage. The directional nozzle 170 simply bends or gives and no harm is done to either nozzle 70 or 170.

The directional nozzle 170 is screwed in the nozzle 70 until tightened and then backed off to provide the directional flow of pool desired.

As a result of the light assembly being made of various assembled components the nozzle 170 is adaptable to the novel light assembly in accordance with this invention.

While the foregoing detailed description has described several exemplary embodiments of the pool light assembly in accordance with this invention, it is to be understood that the above description is illustrative only and not limiting of the disclosed invention. Thus, the invention is to be limited only by the claims as set forth below.

What is claimed is:

1. A pool light assembly connection to a pool side wall, the pool light assembly including a water inlet housing having a water conduit, the pool light assembly comprising:

the water inlet housing having a base and the base having an interior, the base having a notch for allowing water to enter the interior, the interior of the base having a series of ribs and a central opening for allowing water to communicate with the water conduit;

a sealing plate for sealing water between the base interior and the sealing plate, the sealing plate including a central opening sized and shaped for compatible connection with the central opening of the base and allowing water to communicate with the water conduit;

a light sub-assembly including means for pool illumination, the light sub-assembly defining a ring fitting sized and shaped to fit within the periphery of the sealing plate; and a retaining means for retaining the light sub-assembly in place with the aforementioned components, wherein the water inlet includes a nozzle end, which is rotatable and secured to the light assembly by the retaining means.

2. The pool light assembly as set forth in claim 1, wherein the nozzle end defines an eyeball socket.

3. The pool light assembly as set forth in claim 2, wherein the nozzle end defines a directional nozzle for directing pool water flow.

4. A pool light assembly connection to a pool side wall, the pool light assembly including a water inlet housing having a water conduit, the pool light assembly comprising:

the water inlet housing having a base and the base having an interior, the base having a notch for allowing water to enter the interior, the interior of the base having a series of ribs and a central opening for allowing water to communicate with the water conduit;

a sealing plate for sealing water between the base interior and the sealing plate, the sealing plate including a central opening sized and shaped for compatible connection with the central opening of the base and allowing water to communicate with the water conduit;

a light sub-assembly including means for pool illumination, the light sub-assembly defining a ring fitting sized and shaped to fit within the periphery of the sealing plate; and retaining means retaining the light sub-assembly in place with the aforementioned components, wherein the assembly is attachable to a power supply head through the plug-in means.

* * * * *